US006615923B1

(12) United States Patent
Lay, Jr. et al.

(10) Patent No.: US 6,615,923 B1
(45) Date of Patent: Sep. 9, 2003

(54) ROV-DEPLOYABLE SUBSEA WELLHEAD PROTECTOR

(76) Inventors: Milford Lay, Jr., P.O. Box 1537, Morgan City, LA (US) 70381; Gregory J. Landry, 608 Oak Manor Dr., New Iberia, LA (US) 70563

( * ) Notice: Subject to any disclaimer, the term of this patent is extended or adjusted under 35 U.S.C. 154(b) by 0 days.

(21) Appl. No.: 10/198,470

(22) Filed: Jul. 17, 2002

(51) Int. Cl.[7] ..... E21B 29/12

(52) U.S. Cl. ..... 166/368; 166/971; 166/75.13; 166/343; 166/339

(58) Field of Search ..... 166/368, 343, 166/339, 340, 341, 360, 366, 97.1, 75.13

(56) References Cited

U.S. PATENT DOCUMENTS

| | | | | | |
|---|---|---|---|---|---|
| 2,605,847 | A | * | 8/1952 | McCoy | 166/54 |
| 3,459,259 | A | * | 8/1969 | Matthews | 166/358 |
| 3,551,005 | A | * | 12/1970 | Brun | 285/10 |
| 4,691,781 | A | * | 9/1987 | Gano | 166/368 |
| 4,706,757 | A | * | 11/1987 | Harrington | 166/349 |
| 4,867,605 | A | * | 9/1989 | Myers et al. | 405/169 |
| 4,936,351 | A | * | 6/1990 | Wells et al. | 138/89 |
| 4,943,187 | A | * | 7/1990 | Hopper | 405/190 |
| 5,010,956 | A | * | 4/1991 | Bednar | 166/344 |
| 5,069,287 | A | * | 12/1991 | Short et al. | 166/339 |
| 5,107,931 | A | | 4/1992 | Valka et al. | |
| 5,129,460 | A | | 7/1992 | Ritter, Jr. | |
| 5,184,608 | A | * | 2/1993 | Hale, III | 138/89 |
| 5,868,204 | A | * | 2/1999 | Pritchett et al. | 166/368 |
| 5,929,330 | A | * | 7/1999 | Ford | 73/146.8 |
| 5,967,235 | A | * | 10/1999 | Scott | 166/379 |
| 5,992,526 | A | | 11/1999 | Cunningham et al. | |
| 6,076,605 | A | * | 6/2000 | Lilley et al. | 166/368 |
| 6,109,352 | A | * | 8/2000 | Edwards et al. | 166/336 |
| 6,474,416 | B2 | * | 11/2002 | Beall et al. | 166/343 |
| 6,502,632 | B1 | * | 1/2003 | Pittman | 166/75.13 |
| 2003/0010499 | A1 | * | 1/2003 | Qvam et al. | 166/335 |
| 2003/0019632 | A1 | * | 1/2003 | Humphrey et al. | 166/368 |

* cited by examiner

*Primary Examiner*—Thomas B. Will
*Assistant Examiner*—Thomas A. Beach
(74) *Attorney, Agent, or Firm*—Jesse D. Lambert

(57) ABSTRACT

A protector for placement over subsea wellheads. A main body is cylindrical, with an inner diameter of sufficiant size to fit over a subsea wellhead. One end of the main body has a cap across it. A vent and a pump-through port, which permits pumping in of corrosion inhibitors, is in the cap. The open end of the main body has an outwardly flaring skirt to help guide the protector into place over the wellhead. The main body is formed from polyurethane via molding or other suitable methods.

11 Claims, 3 Drawing Sheets

FIG. 5
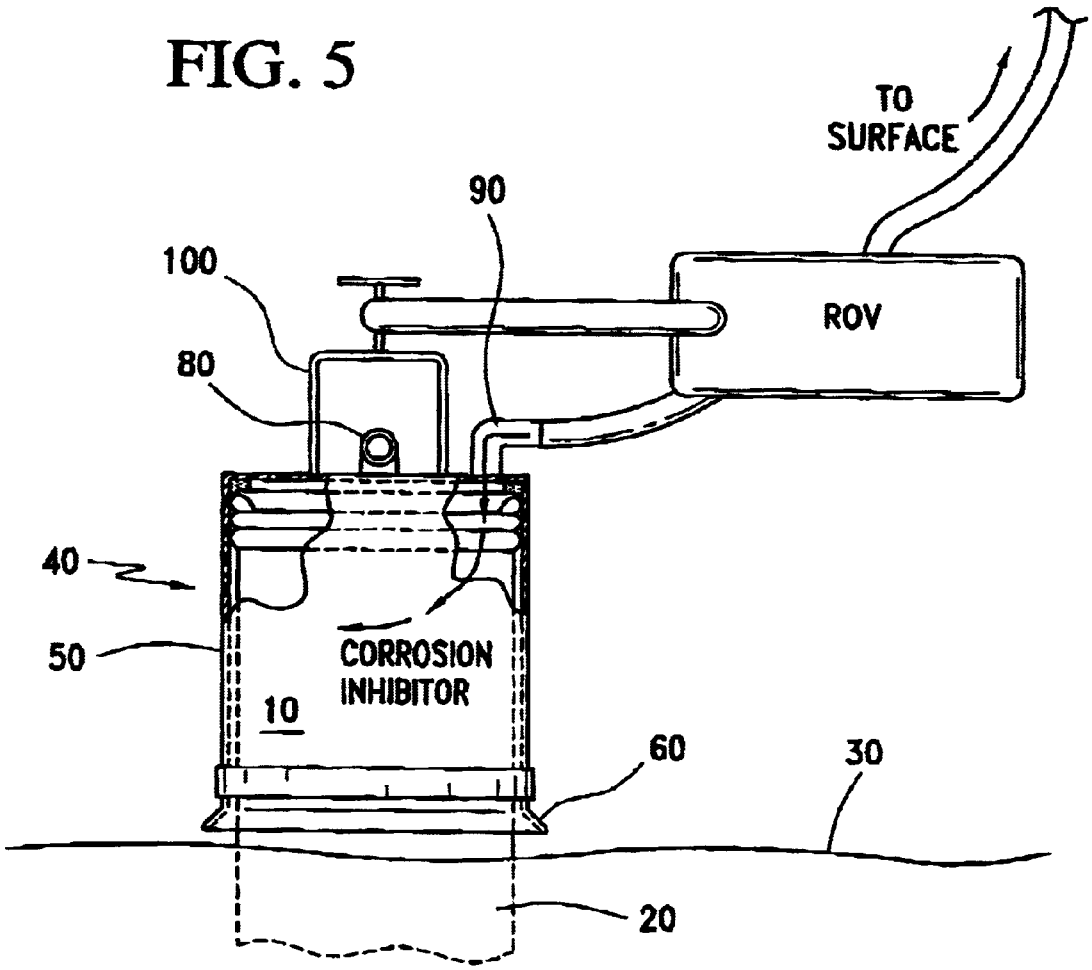
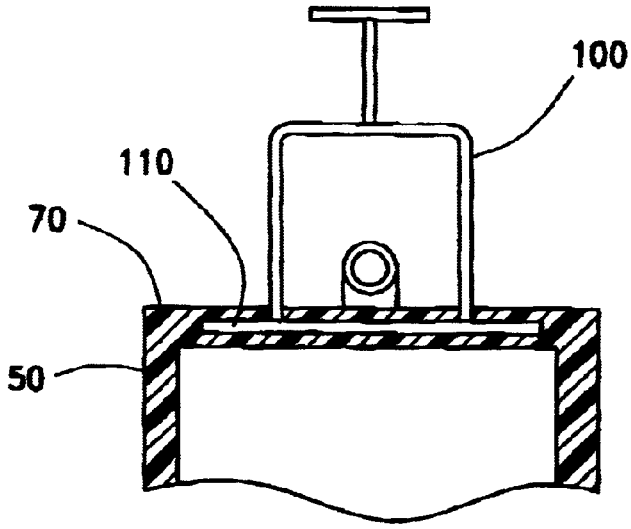
FIG. 6

ROV-DEPLOYABLE SUBSEA WELLHEAD PROTECTOR

BACKGROUND - FIELD OF ART

This invention relates to apparatus used in offshore oil and gas operations. With more specificity, this invention relates to apparatus for the protection of the subsea wellheads of offshore wells.

BACKGROUND - RELATED ART

In relatively shallow offshore waters, wells are drilled from bottom-supported drilling rigs such as jackup rigs. When such wells are completed, the completion can often be carried out by a surface wellhead mounted on some sort of production structure, for example a standalone well caisson. The wellhead equipment for such wells is very similar to equipment on onshore wells or platform wells.

In deeper waters, however, wells must be drilled with floating drilling rigs such as semi-submersibles and drill ships. Exploratory wells drilled in deeper waters are often simply plugged and abandoned. However, current technology permits many of such wells to be "salvaged" in the sense that the wells are eventually completed and tied back to a production facility, in a so-called "subsea completion."

A typical sequence is that after the well has been drilled and all logging, testing and the like is complete, the well must be temporarily "abandoned" for a period of time, while the drilling rig moves off, and until the well can be completed. Often, additional wells are drilled to delineate a field, and if economically justified all of the temporarily abandoned wells are completed and tied back to a production facility.

The temporary abandonment is usually accomplished by setting mechanical and/or cement plugs in the wellbore. However, while such plugs effectively isolate the wellbore from the environment, the subsea wellhead, which rests on and protrudes above the sea floor, is left exposed and unprotected. Protection of the subsea wellhead is essential, as it has multiple seal surfaces and outer profiles which must remain undamaged for a subsea production assembly to be mounted atop the wellhead. Possible sources of damage include corrosion from the immersion in sea water; objects falling onto the subsea wellhead and scarring the various surfaces; or damage by objects falling on or otherwise striking the wellhead, such as boat anchors and the like.

Past efforts have been implemented to protect the subsea wellhead with various types of protectors which fit over the wellhead. Prior art subsea wellhead protectors have been made of metals of different sorts. While such protectors may be effective, their great weight requires that they be run using the drilling rig to lower the protector in place, usually on a string of drill pipe. This requirement means that expensive rig time must be devoted to the placement of metal protectors.

A tremendous economic incentive exists for a subsea wellhead protector which can be run without requiring use of a drilling rig, for example by use of a subsea Remotely Operated Vehicle ("ROV"), which may be deployed from the rig while still in place over the well, yet frees the rig to do other tasks such as pulling anchors. Alternatively, it is desirable to have a wellhead protector which could be placed by an ROV deployed from a ship or other vessel, without a rig on location.

SUMMARY OF THE INVENTION

The present invention is a subsea wellhead protector having a minimum of metal components, with most of the protector formed from an elastomer such as polyurethane. The result is a light weight yet strong wellhead protector, which does not require a rig to hoist it and set it in place atop a subsea wellhead, but instead can be placed atop the subsea wellhead with an ROV.

BRIEF DESCRIPTION OF THE DRAWINGS

FIG. 5 is a partial cross section view of the subsea wellhead protector, in place atop a subsea wellhead, and depicting corrosion inhibitor being injected.

FIG. 6 shows one embodiment of the ROV handling arm and support plate molded in place.

DESCRIPTION OF THE PRESENTLY PREFERRED EMBODIMENT

While various embodiments within the scope of the present invention will be apparent to those skilled in the art, with reference to the figures some of the presently preferred embodiments are described.

Figure 1:
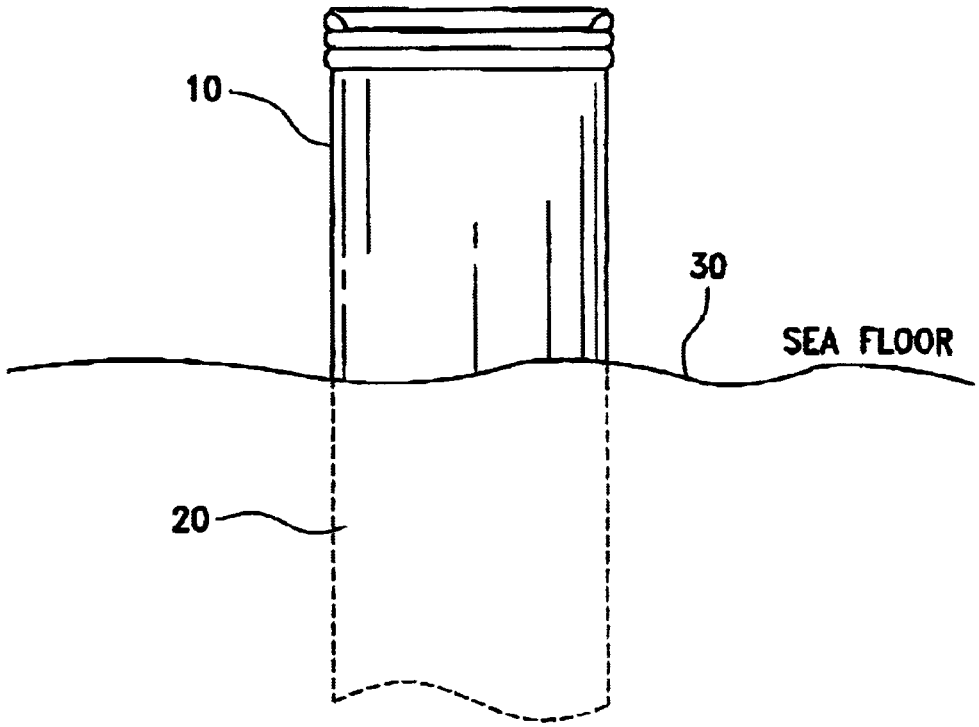
FIG. 1 is a view of a subsea wellhead protruding above the sea floor.

FIG. 1 shows a typical subsea wellhead arrangement. Subsea wellhead 10 sits atop a casing string 20 which is cemented in a subterranean borehole. Subsea wellhead 10 is usually in relatively close proximity to sea floor 30. A support mat may be in place to provide additional stability and bearing surface against sea floor 30. The wellhead typically has multiple sealing and connector surfaces which must be protected.

Figure 2:
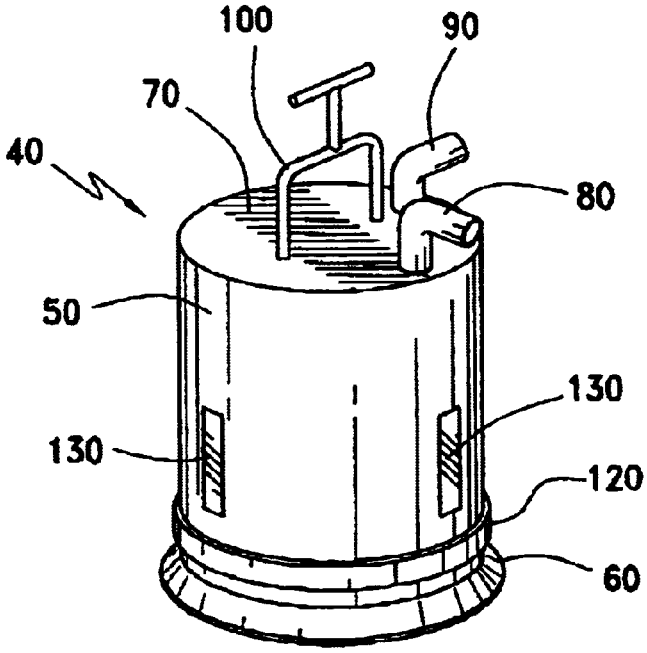
FIG. 2 is a perspective view of the subsea wellhead protector.
Figure 3:
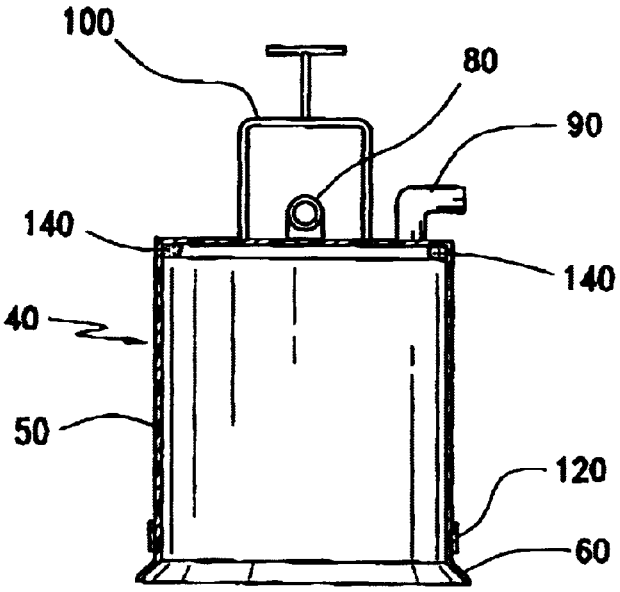
FIG. 3 is a side view in partial cross section of the subsea wellhead protector.

FIGS. 2 and 3 show various views of protector 40. FIG. 2 is a perspective view of protector 40. FIG. 3 is a view in partial cross section. Protector 40 comprises a hollow cylindrical main body 50, preferably with an outwardly flaring circumferential skirt 60 around an open end. A cover 70 encloses the other end of main body 50. A vent 80 provides hydraulic communication through cover 70. A flow through fluid port 90 (commonly referred to in the industry as a "hot stab port") is disposed in the main body. Fluid port 90 provides a connector for a tube used for injection of corrosion inhibitor into the protector/wellhead interior, as is later described, and has a check valve inside to permit fluid flow into, but not out of, protector 40. In FIGS. 2–3, both vent 80 and port 90 are shown in cover 70, but it is understood that both vent 80 and port 90 could be placed in cover 70, in a wall of main body 50, or at the juncture of cover 70 and main body 50. Observation ports 130 penetrate the wall of main body 50 and permit visual confirmation that the protector is properly seated on the subsea wellhead.

Protector 40 is suited for placement atop a subsea wellhead by an ROV guiding it into place. Accordingly, the preferred embodiment further comprises an ROV handle 100, which can be readily grasped by the gripping mechanism of an ROV. Different embodiments of ROV handle 100 are possible. One presently preferred embodiment as shown herein comprises an inverted U-shape member, with a T-handle in turn connected to the U-shaped member. It is understood that other embodiments of the ROV handle are possible, such as a T-handle alone, an inverted U-shape alone, a ring, or even a ball. In the preferred embodiment, in order to provide a secure connection, ROV handle 100 is attached to a plate 110 which is molded into cover 70 when main body 50 is formed; FIG. 6 shows this in further detail. Additional strength can be added to protector 40 by a band 120, preferably of stainless steel, encircling main body 50. Band 120 may be attached by a clamp type mechanism, or other means well known in the art.

Different non-metallic materials are suitable for the protector. Generally, elastomers of different types are the preferred material, due to the pliable nature of such materials. It is understood, however, that various types of plastics such as polyethylene (which are, generally speaking, not as pliable as elastomers) could also be used. Examples of suitable elastomers include neoprene and polyurethane. A presently preferred embodiment utilizes a polyether polyurethane having a sufficient hardness to accommodate the water depth for a given application. Polyether polyurethanes typically exhibit a resistance to degradation in seawater, and have negligible transmittance of seawater into the protector, or corrosion inhibitors such as glycerol out of the protector by a "leaching" process. The pliable nature of the polyurethane also aids in sealing and conforming to the contours of the subsea wellhead. However, it is recognized that other non-metallic materials could be used, such as plastics made from other resins, fiberglass, polyethylene, and various types of fiber-reinforced composites.

Preferably, the protector is formed by a pour molding process well known in the art. Polyurethanes are in a liquid state when uncured, which permits easy molding to a variety of contours. Typically, the polyurethane is composed of a prepolymer, a curative, and a pigment. The mold comprises a simple plug and cavity mold, and the metal components (such as the vent, the ROV handle, and the fluid port) are supported in the mold cavity, so that the polyurethane can flow around via gravity feed and encapsulate the metal components. In addition to pour molding, the molding process may be injection molding or other methods well known in the molding field.

As additional protection for perhaps the most critical surface on the subsea wellhead, and to aid in retaining corrosion inhibitor injected into the wellhead, a resilient circumferential gasket 140 may be mounted on the underside of cover 70. This position puts gasket 140 in contact with the uppermost seal surface of the subsea wellhead, commonly known as the "BX bevel." Preferably, gasket 140 is fixed in place when main body 50 is molded.

Dimensions of protector 40 may be as suitable for different sizes, makes, etc. of subsea wellheads. When made in typical sizes, protector 40 weighs on the order of 200 lbs. in air, and 50 lbs. in sea water. However, it is understood that the scope of the invention is not limited to any particular size of protector.

Figure 4:
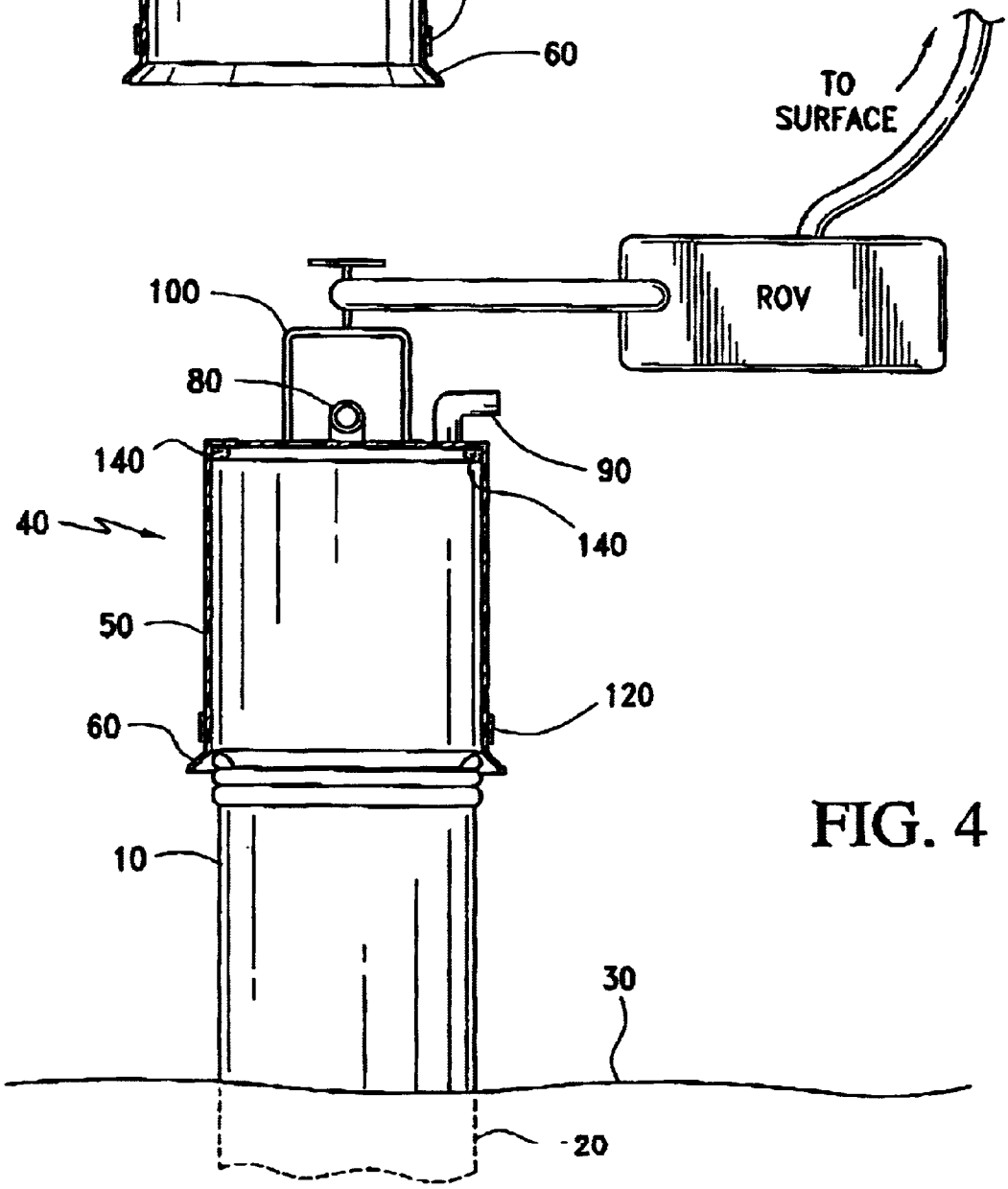
FIG. 4 is a partial cross section view of the subsea wellhead protector, being lowered into place atop a subsea wellhead by an ROV.

With reference to FIG. 4: to run the protector, an ROV grasps ROV handle 100 with its gripping arm, and the ROV and protector are launched from a rig or other vessel. A control umbilical for the ROV connects the ROV to the vessel. Using the ROV controls and video, protector 40 is maneuvered to a position over subsea wellhead 10, and lowered into place. FIG. 5 shows protector 40 fully seated on subsea wellhead 10. Gasket 140 seals against subsea wellhead 10. Typically, after protector 40 is fully seated, an injection line from the ROV is inserted into fluid port 90, and corrosion inhibitor (such as glycerol) is allowed to flow into subsea wellhead 10 under the influence of hydrostatic pressure acting on the corrosion inhibitor tanks carried on the ROV.

While the above description contains many specificities, it is understood that same are presented to illustrate some of the presently preferred embodiments and not by way of limitation. Variations can be made in the embodiments of the invention without departing from its scope. For example, the outer and inner shapes of the wellhead protector can be varied.

While the invention is directed toward non-metallic materials, different ones can be used, such as polyurethane, fiberglass composites, etc. The shapes and placements of the ROV arms can be varied. The pump-through port, through which corrosion inhibitors can be placed, can be of different configurations.

Therefore, the scope of the invention is not to be limited by the examples set forth, but only by the appended claims and their legal equivalents.

We claim:

1. A protector for subsea wellheads, comprising:

a) a main body comprising a hollow cylindrical portion with a cap across one end, and having an inner diameter of sufficient size to fit over a subsea wellhead, said main body formed from an elastomer;

b) a fluid port comprising a check valve assembly, permitting fluid injection into said main body, disposed on said main body;

c) a fluid vent disposed on said main body;

d) an ROV handle attached to and protruding from said main body, said handle adapted to be grasped by the grasping arm of an ROV, wherein a weight of said protector is sufficiently low for an ROV to manipulate and position said protector atop a subsea wellhead.

2. The protector of claim 1, wherein said main body further comprises an outwardly-flaring circumferential skirt around an open end of said main body.

3. The protector of claim 1, further comprising at least one observation port in a wall of said main body.

4. The protector of claim 1, wherein said elastomer comprises a polyurethane.

5. The protector of claim 4, wherein said protector is formed by a pour molding process.

6. A lightweight, ROV-deployable protector for subsea wellheads, comprising:

a) a main body comprising a hollow cylindrical portion with a cap across one end, and having an inner diameter of sufficient size to fit over a subsea wellhead, and further comprising an outwardly-flaring circumferential skirt around an open end of said main body and at least one observation port in a wall of said main body, said main body formed from a polyether polyurethane;

b) a fluid port comprising a check valve assembly, permitting fluid injection into said main body, disposed on said main body;

c) a fluid vent disposed on said main body;

d) an ROV handle attached to and protruding from said main body, said handle adapted to be grasped by the grasping arm of an ROV, wherein a weight of said protector is sufficiently low for an ROV to manipulate and position said protector atop a subsea wellhead.

7. The protector of claim 6, wherein said protector is formed by a pour molding process.

8. A protector for subsea wellheads, comprising:

a) a main body comprising a hollow cylindrical portion with a cap across one end, and having an inner diameter of sufficient size to fit over a subsea wellhead, said main body formed from a plastic;

b) a fluid port comprising a check valve assembly, permitting fluid injection into said main body, disposed on said main body;

c) a fluid vent disposed on said main body;

d) an ROV handle attached to and protruding from said main body, said handle adapted to be grasped by the grasping arm of an ROV, wherein a weight of said protector is sufficiently low for an ROV to manipulate and position said protector atop a subsea wellhead.

9. The protector of claim 8, wherein said main body further comprises an outwardly-flaring circumferential skirt around an open end of said main body.

10. The protector of claim 8, further comprising at least one observation port in a wall of said main body.

11. The protector of claim 8, wherein said protector is formed by a pour molding process.

* * * * *

UNITED STATES PATENT AND TRADEMARK OFFICE

CERTIFICATE OF CORRECTION

PATENT NO. : 6,615,923 B1
APPLICATION NO. : 10/198470
DATED : September 9, 2003
INVENTOR(S) : Milford Lay, Jr. and Gregory J. Landry It is certified that error appears in the above-identified patent and that said Letters Patent is hereby corrected as shown below:

On the title page item (76),

The inventors of this patent are changed to read:

Michael Dean Arning, Milford Lay, Jr., and Gregory J. Landry.

This correction adds Michael Dean Arning as the first named inventor.

Signed and Sealed this

Twenty-seventh Day of May, 2008

JON W. DUDAS
*Director of the United States Patent and Trademark Office*